US011215365B2

(12) United States Patent
Myatlev et al.

(10) Patent No.: US 11,215,365 B2
(45) Date of Patent: Jan. 4, 2022

(54) NOZZLE FOR COMBUSTORS, COMBUSTOR, AND GAS TURBINE INCLUDING THE SAME

(71) Applicant: DOOSAN HEAVY INDUSTRIES & CONSTRUCTION CO., LTD., Changwon-si (KR)

(72) Inventors: Alexander Myatlev, Gimhae-si (KR); Jungmin Seok, Goyang-si (KR); Borys Shershnyov, Changwon-si (KR)

( * ) Notice: Subject to any disclaimer, the term of this patent is extended or adjusted under 35 U.S.C. 154(b) by 321 days.

(21) Appl. No.: 16/224,870

(22) Filed: Dec. 19, 2018

(65) Prior Publication Data

US 2019/0257522 A1 Aug. 22, 2019

(30) Foreign Application Priority Data

Feb. 20, 2018 (KR) ..... 10-2018-0019984

(51) Int. Cl.
*F23R 3/28* (2006.01)
*F23R 3/34* (2006.01)

(52) U.S. Cl.
CPC ..... *F23R 3/286* (2013.01); *F23R 3/28* (2013.01); *F23R 3/283* (2013.01); *F23R 3/343* (2013.01); *F23R 2900/00017* (2013.01)

(58) Field of Classification Search
CPC .... F02C 3/30; F02C 3/305; F23R 3/28; F23R 3/283; F23R 3/30; F23R 3/34; F23R 3/343; F23R 3/36
See application file for complete search history.

(56) References Cited

U.S. PATENT DOCUMENTS 6,925,809 B2 * 8/2005 Mowill ..... F23R 3/26 60/737
7,143,583 B2 * 12/2006 Hayashi ..... F23R 3/18 60/776

(Continued)

FOREIGN PATENT DOCUMENTS

JP 2015-535583 A 12/2015
JP 2017-521624 A 8/2017

(Continued)

OTHER PUBLICATIONS

Woodward FST, Inc.; APS500-R Primary Tip; Reference P/N 527P899-01; Mar. 15, 2004 (Year: 2004).*

(Continued)

*Primary Examiner* — Todd E Manahan
*Assistant Examiner* — Sean V Meiller
(74) *Attorney, Agent, or Firm* — Harvest IP Law, LLP

(57) ABSTRACT

A nozzle, a combustor, and a gas turbine are capable of efficiently atomizing fuel. The nozzle includes an outer tube; a first inner tube installed in the outer tube and configured to form an air passage between the first inner tube and the outer tube; a second inner tube installed in the first inner tube and configured to form a main fuel passage between the first inner tube and the second inner tube and to form a pilot fuel passage within the second inner tube; and a splash plate configured to form a first space between the outer tube and the splash plate, the first space communicating with the main fuel passage and with the air passage, and to form an injection slot communicating with the first space, the splash plate having a front end and a diameter increasing toward the front end.

18 Claims, 9 Drawing Sheets

(56) References Cited

U.S. PATENT DOCUMENTS

| | | | | |
|---|---|---|---|---|
| 8,166,763 | B2 | 5/2012 | Piper et al. | |
| 9,383,107 | B2 | 7/2016 | Shershnyov et al. | |
| 9,488,108 | B2 * | 11/2016 | Ryon | F15D 1/08 |
| 2015/0000285 | A1 | 1/2015 | Deiss et al. | |
| 2015/0135716 | A1 * | 5/2015 | Ginessin | F23R 3/286<br>60/737 |
| 2016/0237911 | A1 * | 8/2016 | Chabaille | F23R 3/343 |
| 2017/0038074 | A1 * | 2/2017 | Myers | F23R 3/286 |
| 2017/0122212 | A1 * | 5/2017 | Cadman | F23R 3/28 |
| 2017/0159561 | A1 * | 6/2017 | Shershnyov | F23R 3/28 |
| 2017/0176000 | A1 | 6/2017 | Shershnyov et al. | |

FOREIGN PATENT DOCUMENTS

| | | | |
|---|---|---|---|
| KR | 10-1760736 | B1 | 7/2017 |
| WO | 2013/115671 | A1 | 8/2013 |

OTHER PUBLICATIONS

A Korean Office Action dated Apr. 18, 2019 in connection with Korean Patent Application No. 10-2018-0019984 which corresponds to the above-referenced U.S. application.

* cited by examiner

NOZZLE FOR COMBUSTORS, COMBUSTOR, AND GAS TURBINE INCLUDING THE SAME

CROSS-REFERENCE TO RELATED APPLICATIONS

This application claims priority to Korean Patent Application No. 10-2018-0019984 filed on Feb. 20, 2018, the disclosure of which is incorporated herein by reference in its entirety.

BACKGROUND OF THE DISCLOSURE

Field of the Disclosure

Exemplary embodiments of the present disclosure relate to a nozzle for combustors, a combustor, and a gas turbine including the combustor.

Description of the Related Art

A gas turbine is a power engine configured to mix fuel with air compressed by a combustor, combust the mixture of the fuel and the compressed air, and rotate a turbine using high-temperature gas generated by the combustion. Gas turbines are used to drive a generator, an aircraft, a vessel, a train, and so forth.

Generally, gas turbines include a compressor, a combustor, and a turbine. The compressor draws in and compresses external air and then transmits the compressed air to the combustor. Air compressed by the compressor enters a high-pressure and high-temperature state. The combustor mixes fuel with compressed air supplied from the compressor, and combusts the mixture. Combustion gas generated by the combustion is discharged to the turbine. Turbine blades provided in the turbine are rotated by the combustion gas, whereby power is generated. Generated power may be used in various fields, e.g., for generating electricity or driving a mechanical device.

Fuel is discharged through a nozzle installed in each combustor. The nozzle may discharge liquid fuel. Typically, each nozzle may be formed of a liquid atomization nozzle for spraying a fixed quantity of liquid into a combustion chamber. There is a need for such a nozzle having a simple structure that is capable of efficiently atomizing fuel.

SUMMARY OF THE DISCLOSURE

An object of the present disclosure is to provide a nozzle, a combustor, and a gas turbine capable of efficiently atomizing fuel.

Other objects and advantages of the present disclosure can be understood by the following description, and become apparent with reference to the embodiments of the present disclosure. Also, it will be clear to those skilled in the art to which the present disclosure pertains that the objects and advantages of the present disclosure can be realized by the means as claimed and combinations thereof.

In accordance with one aspect of the present disclosure, there is provide a nozzle for a combustor. The nozzle may include an outer tube; a first inner tube installed in the outer tube and configured to form an air passage between the first inner tube and the outer tube; a second inner tube installed in the first inner tube and configured to form a main fuel passage between the first inner tube and the second inner tube and to form a pilot fuel passage within the second inner tube; and a splash plate configured to form a first space between the outer tube and the splash plate, the first space communicating with the main fuel passage and with the air passage, and to form an injection slot communicating with the first space, the splash plate having a front end and a diameter increasing toward the front end.

The injection slot may be formed between an outer circumferential surface of the outer tube and the front end of the splash plate.

The nozzle may further include a plurality of struts installed in the first space so as to couple the splash plate with the outer tube and arranged at positions spaced apart from each other in a circumferential direction of the first space. The first space may include a divided region divided into spaces by the struts, and a connected region communicating with the spaces of the divided region and extending in a circumferential direction of the splash plate.

The nozzle may further include a first barrier between the first space and the air passage, in which a plurality of first connection holes are formed to connect the first space with the air passage; and a second barrier between the first space and the main fuel passage, in which a plurality of second connection holes are formed to connect the first space with the main fuel passage.

The nozzle may further include a curtain barrier in which a plurality of air curtain holes for communicating with the air passage are formed. The pilot fuel passage may have a front end in which an injection hole is formed, and the curtain barrier may be disposed in front of the injection hole to enclose a space in front of the injection hole. The air curtain holes may communicate with the air passage through a plurality of connection passages in communication with a cooling guide flow passage extending in a circumferential direction of the second inner tube. The nozzle may have a front end formed by an inclined part formed by the splash plate; a planar part having a planar surface communicating with a rear end of the inclined part; and a recessed part formed in the planar part, the recessed part having a side surface formed by the curtain barrier and a bottom surface in which the injection hole is formed.

The nozzle may further include a flow guide member installed in the pilot fuel passage, the flow guide member including a head having an outer circumferential surface in which a guide groove extending in a spiral shape is formed. The flow guide member may further include a guide tube coupled with the head, and the guide tube may include a diverging passage communicating with an inlet passage formed in a rear end of the guide tube; and a plurality of outlet passages each communicating with a front end of the diverging passage and with an outer circumferential surface of the guide tube. The outer circumferential surface of the guide tube may have an inclined cross section such that an outer diameter of the guide tube is gradually reduced toward a front end of the guide tube, and the outlet passages may occur in the guide tube where the outer circumferential surface of the guide tube is inclined.

The flow guide member may further include a guide protrusion having a conical shape protrudes rearward from the head. The guide protrusion may include an outer circumferential surface in which a plurality of channels extending outward from a center of the guide protrusion and extending in a longitudinal direction of the guide protrusion are formed.

In accordance with another aspect of the present disclosure, there is provided a combustor including a burner having a plurality of nozzles configured to eject fuel and air, and a duct assembly coupled to one side of the burner and configured to combust the ejected fuel and air and transfer combustion gas to a turbine. Each nozzle may include an outer tube; a first inner tube installed in the outer tube and configured to form an air passage between the first inner tube and the outer tube; a second inner tube installed in the first inner tube and configured to form a main fuel passage between the first inner tube and the second inner tube and to form a pilot fuel passage within the second inner tube; and a splash plate configured to form a first space between the outer tube and the splash plate, the first space communicating with the main fuel passage and with the air passage, to form an injection slot communicating with the first space, and to diffuse fuel transferred from the main fuel passage.

In accordance with another aspect of the present disclosure, there is provide a gas turbine including a compressor configured to compress air drawn from an outside, a combustor configured to produce combustion gas by mixing fuel with the compressed air and combust the mixture, and a turbine including a plurality of turbine blades configured to be rotated by the combustion gas. The combustor may include a burner having a plurality of nozzles configured to eject fuel and air, and a duct assembly coupled to one side of the burner and configured to combust the ejected fuel and air and transfer the combustion gas to the turbine. Each nozzle may include an outer tube; a first inner tube installed in the outer tube and configured to form an air passage between the first inner tube and the outer tube; a second inner tube installed in the first inner tube and configured to form a main fuel passage between the first inner tube and the second inner tube and to form a pilot fuel passage within the second inner tube; and a splash plate configured to form a first space between the outer tube and the splash plate, the first space communicating with the main fuel passage and with the air passage, and to form an injection slot communicating with the first space; and a curtain barrier in which a plurality of air curtain holes for communicating with the air passage are formed, wherein the pilot fuel passage has a front end in which an injection hole is formed, and the curtain barrier is disposed in front of the injection hole to enclose a space in front of the injection hole.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The above and other objects, features and other advantages of the present disclosure will be more clearly understood from the following detailed description taken in conjunction with the accompanying drawings, in which.

DESCRIPTION OF THE EMBODIMENTS

Figure 1:
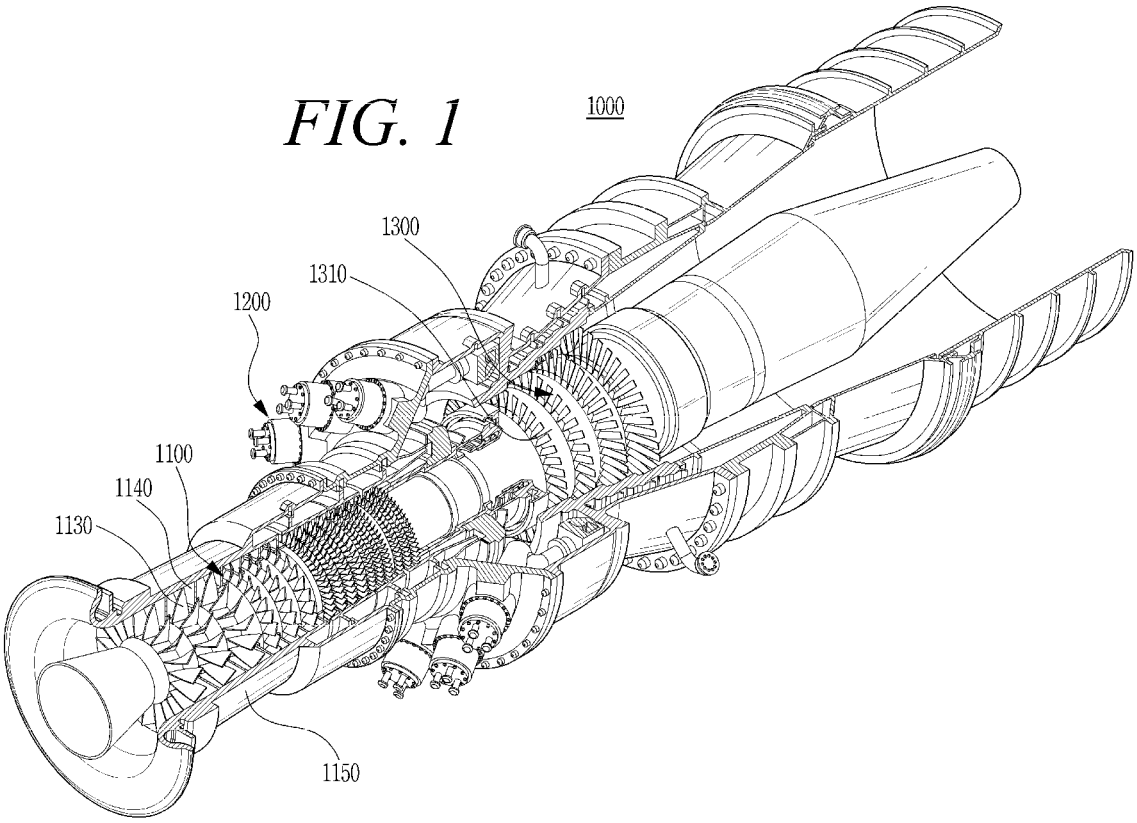
FIG. 1 is a cutaway perspective view of a gas turbine in which may be applied a combustor in accordance with a first embodiment of the present disclosure.

Since the present disclosure may be modified in various forms, and may have various embodiments, preferred embodiments will be illustrated in the accompanying drawings and described in detail with reference to the drawings. However, this is not intended to limit the present disclosure to particular modes of practice, and it is to be appreciated that all changes, equivalents, and substitutes that do not depart from the spirit and technical scope of the present disclosure are encompassed in the present disclosure.

The terminology used herein is for the purpose of describing particular embodiments only and is not intended to be limiting. In the present disclosure, the singular forms are intended to include the plural forms as well, unless the context clearly indicates otherwise. It will be further understood that the terms "comprise", "include", "have", etc. when used in this specification, specify the presence of stated features, integers, steps, operations, elements, components, and/or combinations of them but do not preclude the presence or addition of one or more other features, integers, steps, operations, elements, components, and/or combinations thereof.

Hereinafter, preferred embodiments of the present disclosure will be described in detail with reference to the accompanying drawings. Reference now should be made to the drawings, in which the same reference numerals are used throughout the different drawings to designate the same or similar components. Details of well-known configurations and functions may be omitted to avoid unnecessarily obscuring the gist of the present disclosure. For the same reason, in the accompanying drawings, some elements are enlarged, omitted, or depicted schematically.

Hereinafter, a gas turbine in accordance with a first embodiment of the present disclosure will be described.

Figure 2:
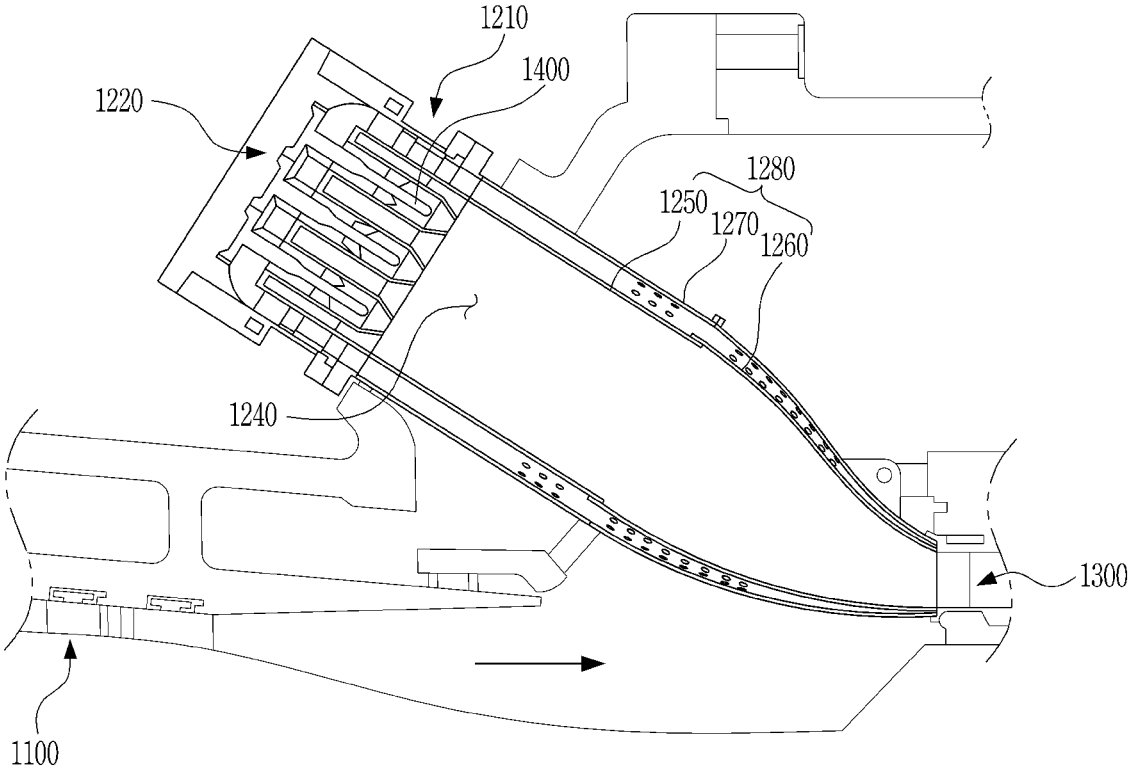
FIG. 2 is a sectional view of a combustor of FIG. 1.

FIG. 1 illustrates the internal structure of a gas turbine in accordance with an embodiment of the present disclosure, and FIG. 2 illustrates a combustor of FIG. 1.

The thermodynamic cycle of the gas turbine 1000 according to the present embodiment ideally complies with the Brayton cycle. The Brayton cycle may consist of four processes including an isentropic compression (adiabatic compression) process, an isobaric heat supply process, an isentropic expansion (adiabatic expansion) process, and an isobaric heat rejection process. In other words, the gas turbine may draw air from the atmosphere, compress the air, combust fuel under isobaric conditions to emit energy, expand this high-temperature combustion gas to convert the thermal energy of the combustion gas into kinetic energy, and thereafter discharge exhaust gas with residual energy to the atmosphere. As such, the Brayton cycle may consist of four processes including compression, heat addition, expansion, and heat rejection.

Embodying the Brayton cycle, the gas turbine 1000 may include a compressor 1100, a combustor 1200, and a turbine 1300, as shown in FIG. 1. Although the following description will be made with reference to FIG. 1, the description of the present disclosure may also be widely applied to a turbine engine having a configuration equivalent to that of the gas turbine 1000 illustrated in FIG. 1.

Referring to FIG. 1, the compressor 1100 of the gas turbine 1000 may draw air from the outside and compress the air. The compressor 1100 may supply air compressed by compressor blades 1130 to the combustor 1200 and also supply air for cooling to a high-temperature area needed to be cooled in the gas turbine 1000. Here, drawn air is compressed in the compressor 1100 through an adiabatic compression process, so that the pressure and the temperature of air passing through the compressor 1100 are increased.

The compressor 1100 is designed in the form of a centrifugal compressor or an axial compressor. Generally, the centrifugal compressor is used in a small gas turbine. On the other hand, in a large gas turbine such as the gas turbine 1000 shown in FIG. 1, a multi-stage axial compressor 1100 is generally used so as to compress a large amount of air. Here, in the multi-stage axial compressor 1100, the blades 1130 of the compressor 1100 rotate along with rotation of a rotor disk, compress drawn air, and transfer compressed air to compressor vanes 1140 disposed at a following stage. Air is compressed gradually to high pressures while passing through the blades 1130 formed in a multi-stage structure.

The compressor vanes 1140 may be mounted to an inner surface of the housing 1150 in such a way that a plurality of compressor vanes 1140 form each stage. The compressor vanes 1140 guide compressed air transferred from the compressor blades 1130 disposed at the preceding stage, toward the blades 1130 disposed at the following stage. In an embodiment, at least some of the plurality of compressor vanes 1140 may be mounted so as to be rotatable within a predetermined range, e.g., to adjust the flow rate of air.

The compressor 1100 may be operated using some of the power output from the turbine 1300. To this end, as shown in FIG. 1, a rotating shaft of the compressor 1100 may be directly coupled with a rotating shaft of the turbine 1300. In the case of the large gas turbine 1000, almost half of the output produced by the turbine 1300 may be consumed to drive the compressor 1100. Therefore, improvement in efficiency of the compressor 1100 will have a direct effect on increasing the overall efficiency of the gas turbine 1000.

The combustor 1200 may mix fuel with compressed air supplied from an outlet of the compressor 1100 and combust the mixture through an isobaric combustion process to make combustion gas having high energy. FIG. 2 illustrates an example of the combustor 1200 applied to the gas turbine 1000. The combustor 1200 may include a combustor casing 1210, a burner 1220, a nozzle 1400, and a duct assembly 1280.

The combustor casing 1210 may enclose a plurality of burners 1220 and have a substantially cylindrical shape. The burners 1220 are disposed downstream of the compressor 1100 and may be arranged along the combustor casing 1210 in an annular pattern. A plurality of nozzles 1400 are provided in each burner 1220. Fuel ejected from the nozzles 1400 is mixed with air at an appropriate ratio to create a mixture having conditions suitable for combustion.

The gas turbine 1000 may use gas fuel, liquid fuel, or hybrid fuel formed by a combination of them. It is important to create combustion conditions suitable for reducing the amount of exhaust gas such as carbon monoxide and nitrogen oxide, which are subject to legal regulation. Recently, use of a pre-mixed combustion scheme has increased because a combustion temperature can be reduced and because uniform combustion is possible so that exhaust gas can be reduced. These advantages have fostered the increase in usage of pre-mixed combustion in spite of the difficulty to control the pre-combustion.

In the case of the pre-mixed combustion, compressed air is mixed with fuel jetted from the nozzles 1400 before the mixture enters the combustion chamber 1240. Initial ignition of pre-mixed gas is performed by an igniter (not shown), and once combustion is stabilized, fuel and air are supplied to maintain the combustion.

Referring to FIG. 2, the duct assembly 1280, which is coupled between the burner 1220 and the turbine 1300 and transmits high-temperature combustion gas, includes an outer surface along which compressed air flows toward the nozzles 1400. This process serves to cool the duct assembly 1280, which is heated by the high-temperature combustion gas being transmitted to the turbine 1300.

The duct assembly 1280 may include a liner 1250, a transition piece 1260, and a flow sleeve 1270. The duct assembly 1280 has a double-shell structure, in which the flow sleeve 1270 encloses the outer surfaces of the liner 1250 and the transition piece 1260 that are coupled to each other. Compressed air enters an annular space defined in the flow sleeve 1270 and cools the liner 1250 and the transition piece 1260.

The liner 1250 is a tube member coupled to the burners 1220 of the combustor 1200, and an internal space of the liner 1250 forms the combustion chamber 1240. One longitudinal end of the liner 1250 is coupled to the burner 1220, and the other longitudinal end of the liner 1250 is coupled to the transition piece 1260.

The transition piece 1260 is coupled to an inlet of the turbine 1300 and functions to guide high-temperature combustion gas into the turbine 1300. One longitudinal end of the transition piece 1260 is coupled with the liner 1250, and the other longitudinal end of the transition piece 1260 is coupled with the turbine 1300. The flow sleeve 1270 functions both to protect the liner 1250 and the transition piece 1260 and to prevent high-temperature heat from being directly emitted to the outside.

Figure 3:
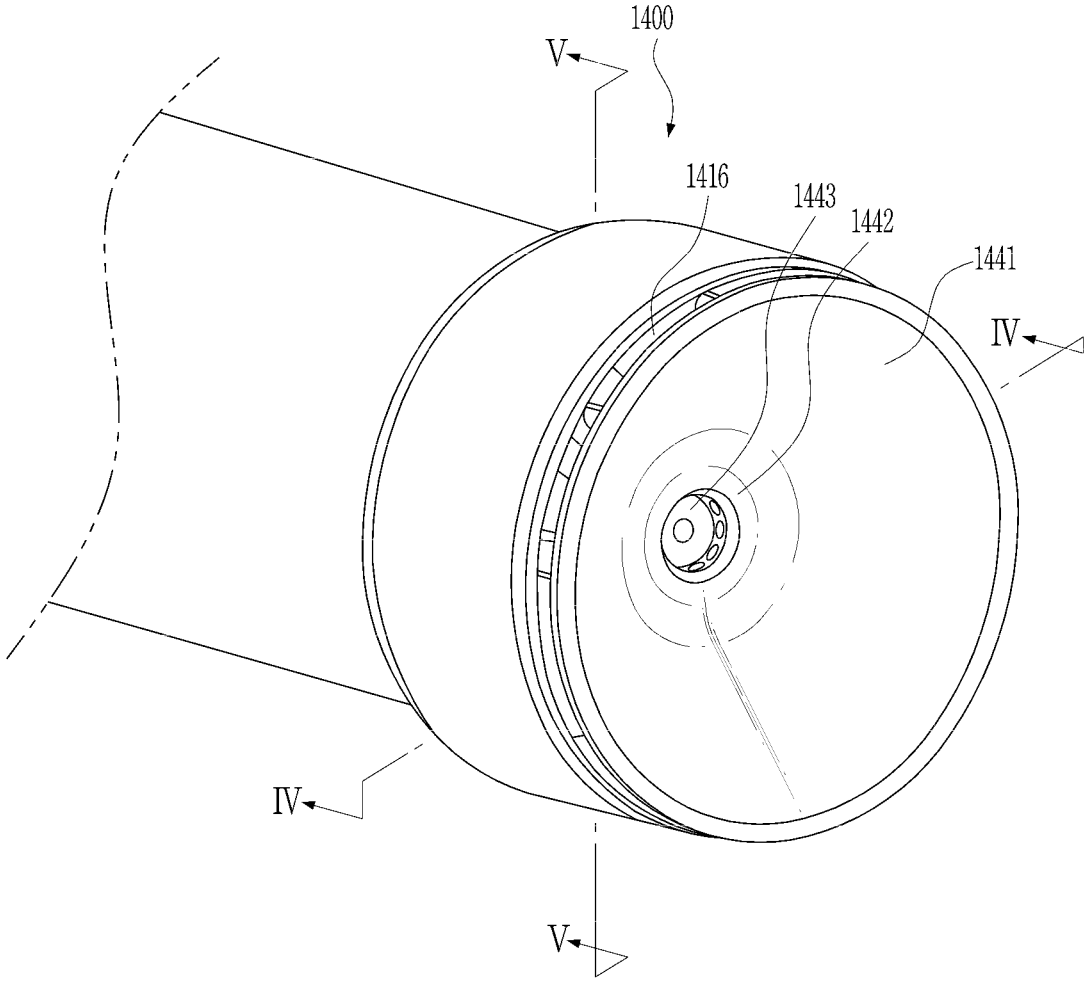
FIG. 3 is a perspective view of a nozzle in accordance with the first embodiment of the present disclosure.
Figure 4:
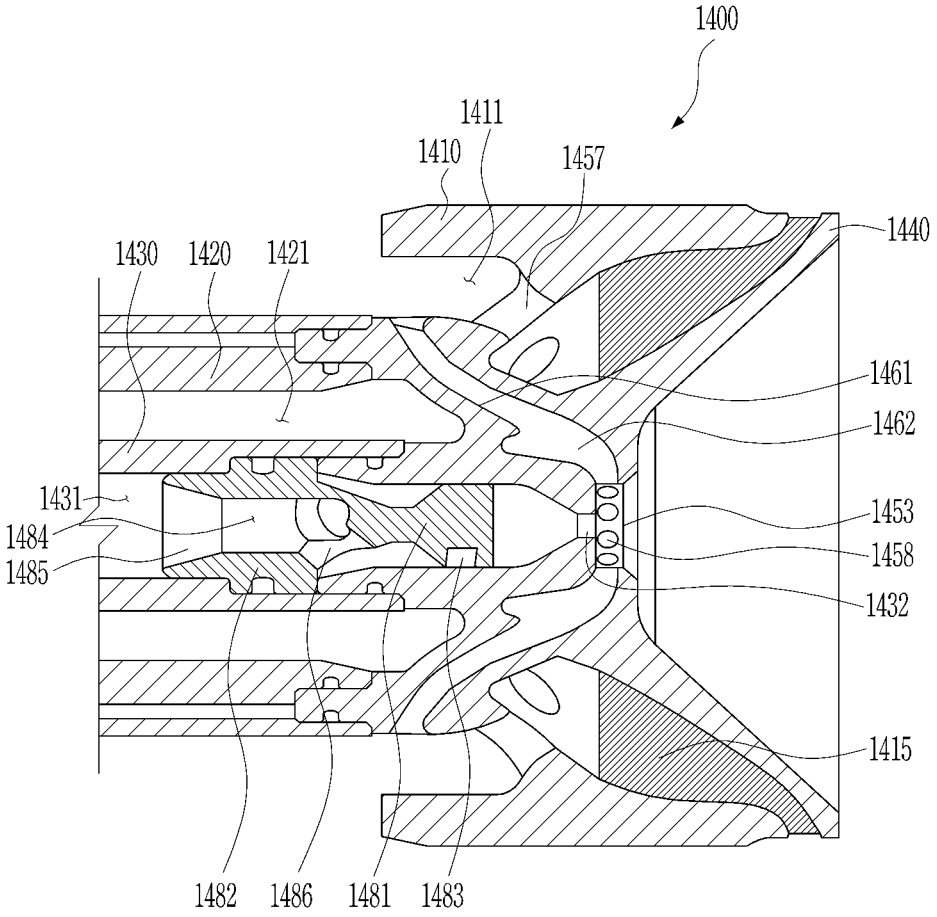
FIG. 4 is a sectional view taken along line IV-IV of FIG. 3.

FIG. 3 illustrates a nozzle 1400 in accordance with the first embodiment of the present disclosure. FIG. 4 is a sectional view taken along line IV-IV of FIG. 3, and FIG. 5 is a sectional view taken along line V-V of FIG. 3.

Figure 5:
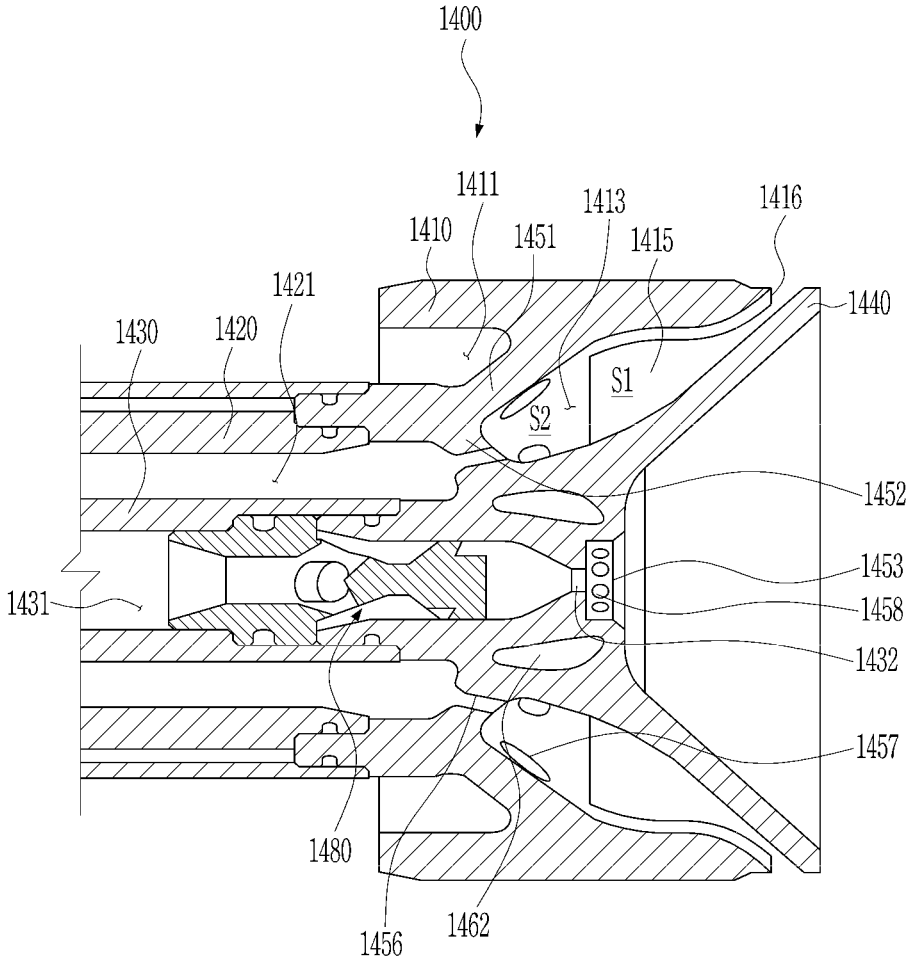
FIG. 5 is a sectional view taken along line V-V of FIG. 3.

Referring to FIGS. 3 to 5, the nozzle 1400 includes an outer tube 1410, a first inner tube 1420, a second inner tube 1430, a splash plate 1440, and a flow guide member 1480.

The outer tube 1410 may be formed of a substantially circular tube having an internal space. A shroud (not shown) for partially covering the outer tube 1410 may be installed outside the outer tube 1410 to guide the flow of air.

The first inner tube 1420 may be disposed in the outer tube 1410, and may be installed coaxially with the outer tube 1410. The first inner tube 1420 forms an air passage 1411 in a space between it and the outer tube 1410. The first inner tube 1420 is formed of a circular tube having an internal space. The second inner tube 1430 may be disposed in the first inner tube 1420, and may be installed coaxially with the first inner tube 1420. The second inner tube 1430 forms a main fuel passage 1421 between it and the first inner tube 1420. The second inner tube 1430 may be formed of a circular tube, and a pilot fuel passage 1431 may be formed in the second inner tube 1430.

An emulsion-type mixture of water and fuel may be supplied into the main fuel passage 1421, and liquid fuel may be supplied into the pilot fuel passage 1431. Here, fuel may employ diesel, but the present disclosure is not limited thereto. Furthermore, gas fuel may be supplied into the main fuel passage 1421 or the pilot fuel passage 1431.

The splash plate 1440 has an inclined side surface such that the diameter of the side surface is increased toward a front end of the splash plate 1440. The splash plate 1440 may be formed of a substantially truncated conical plate. The splash plate 1440 may be coupled to a front end of the second inner tube 1430, or may be inserted into the front end of the second inner tube 1430.

The splash plate 1440 is spaced apart from the outer tube 1410 so that a first space 1413 and an injection slot 1416 are formed between the splash plate 1440 and the outer tube 1410. The splash plate 1440 functions to diffuse fuel drawn into the first space 1413.

The first space 1413 may be formed between an outer circumferential surface of the splash plate 1440 and an inner circumferential surface of the outer tube 1410, and may extend in a circumferential direction of the splash plate 1440. The injection slot 1416 may be formed between an inner circumferential surface of the outer tube 1410 and the front end of the splash plate 1440, and may extend in the circumferential direction of the splash plate 1440 and be divided into a plurality of sections by a strut 1415.

In this embodiment, a plurality of struts 1415 are installed in the first space 1413 at positions spaced apart from each other in a circumferential direction of the first space 1413. The struts 1415 couple to and support the splash plate 1440 and the outer tube 1410. Each strut 1415 may have a substantially planar shape and support the splash plate 1440 so that the splash plate 1440 can be stably fixed on the outer tube 1410.

The strut 1415 extends inward from a front end of the first space 1413 and is formed in only a portion of the first space 1413. Hence, the first space 1413 includes a divided region S1 which is divided into spaces by the struts 1415, and a connected region S2 which communicates with the respective spaces of the divided region S1 and extends in the circumferential direction of the splash plate 1440.

A first barrier 1451 is formed between the first space 1413 and the outer tube 1410. A second barrier 1452 is formed between the first space 1413 and the first inner tube 1420. The first barrier 1451 may include inner and outer portions and may be formed of inclined surfaces such that its outer portion extends forward farther than its inner portion. The second barrier 1452 may also include inner and outer portions and may be formed of inclined surfaces such that its inner portion extends forward farther than its outer portion. The first barrier 1451 and the second barrier 1452 may extend in a circumferential direction of the nozzle 1400 to have substantially annular shapes.

A plurality of first connection holes 1457 are formed in the first barrier 1451 so that the first space 1413 and the air passage 1411 may communicate with each other through the first connection holes 1457. A plurality of second connection holes 1456 are formed in the second barrier 1452 so that the main fuel passage 1421 and the first space 1413 may communicate with each other through the second connection holes 1456. Thereby, the first space 1413 communicates with both the air passage 1411 and the main fuel passage 1421 so that air and fuel may be drawn into the first space 1413. The first connection holes 1457 may be formed toward the center of the nozzle 1400, and the second connection holes 1456 may be formed in an outer direction of the nozzle 1400.

Fuel which is transferred from the second connection holes 1456 to the first space 1413 may employ an emulsion-type mixture of water and fuel, and collide with the splash plate 1440 and move along the surface of the splash plate 1440. Here, since air drawn into the first space 1413 through the first connection holes 1457 is injected toward the surface of the splash plate 1440, the fuel mixture thinly and widely spreads on the surface of the splash plate 1440. The fuel mixture moved to the injection slot along the splash plate 1440 may be atomized while moving away from the front end of the splash plate 1440, and then be sprayed. Furthermore, air is discharged along with the fuel mixture through the injection slot 1416 while cooling the splash plate 1440 and the outer tube 1410.

The first nozzle 1400 has, in the front end thereof, an injection hole 1432 having an inner diameter smaller than a diameter of a peripheral portion thereof. Fuel that moves through the pilot fuel passage 1431 may be ejected through the injection hole 1432. The second inner tube 1430 may be formed such that the inner diameter thereof is gradually reduced toward the injection hole 1432.

A space in front of the injection hole 1432 is enclosed by a curtain barrier 1453, which may have an annular shape and is disposed in front of the injection hole 1432. A plurality of air curtain holes 1458 communicating with inner space of the curtain barrier 1453.

In the front end of the nozzle 1400, an inclined part 1441 is formed by the splash plate 1440, a planar part 1442 having a planar surface communicating with a rear end of the inclined part 1441, and a repressed part 1443 is formed in the planar part 1442. A side surface of the recessed part 1443 forms the curtain barrier 1453. The injection hole 1432 is formed in the bottom surface of the recessed part 1443.

The second connection holes 1456 are formed through a thickness of the second barrier 1452. A plurality of connection passages 1461 extending through the second barrier 1452 are formed in the second barrier 1452. The connection passages 1461 extend in a direction intersecting with the second connection holes 1456 without communicating with the second connection holes 1456.

The plurality of connection passages 1461 connect the air passage 1411 and the air curtain holes 1458 so that air can be transferred from the air passage 1411 to the air curtain holes 1458. A cooling guide flow passage 1462 extends in the circumferential direction of the second inner tube 1430, and the cooling guide flow passage 1462 may communicate with the connection passages 1411. The cooling guide flow passage 1462 may be connected with the air curtain holes 1458. Therefore, air flows drawn through the respective connection passages 1461 join each other in the cooling guide flow passage 1462 and then move to the air curtain holes 1458.

Air that enters the cooling guide flow passage 1462 through the connection passage 1461 cools the front end of the second inner tube 1430, and then cools the air curtain holes 1458 while being discharged through the air curtain holes 1458. Furthermore, the air may not only assist in atomization of fuel while being discharged through the air curtain holes 1458, but it may also maintain a difference in pressure between the inside and the outside of the main fuel passage 1421 to prevent flames or combustion gas from flowing backward.

Figure 6:
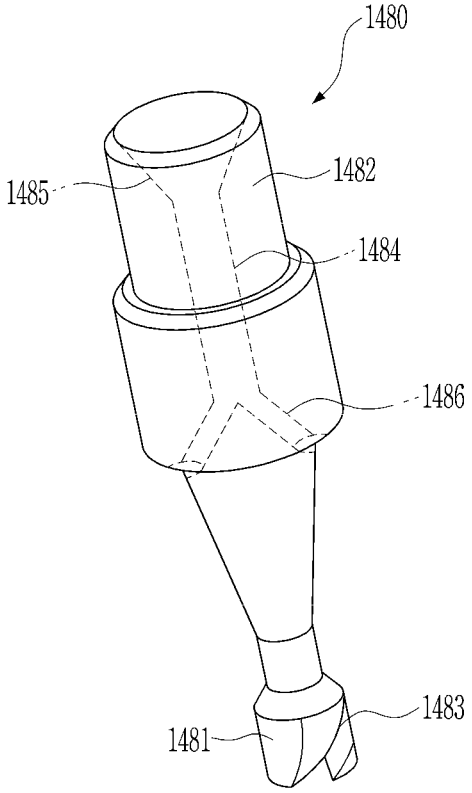
FIG. 6 is a perspective view of a flow guide member in accordance with the first embodiment of the present disclosure.

FIG. 6 illustrates a flow guide member in accordance with the first embodiment of the present disclosure.

Referring to FIGS. 5 and 6, the flow guide member 1480 is inserted into the pilot fuel passage 1431. The flow guide member 1480 includes a head 1481, and a guide tube 1482 coupled with the head 1481. A diverging passage 1484 is formed in the guide tube 1482. The head 1481 has a substantially cylindrical shape. A guide groove 1483 extending in a spiral shape is formed in an outer circumferential surface of the head 1481. In this embodiment, a plurality of guide grooves 1483 are formed in the head 1481, and each guide groove 1483 extends from a rear end of the head 1481 to its front end.

An outer surface of the head 1481 comes into close contact with an outer surface of the second inner tube 1430 so that fuel can move only through the guide grooves 1483. The guide grooves 1483 spirally extend to enable the fuel to swirl. A front surface of the head 1481 may be formed of a planar surface that is perpendicular to the axis of the flow guide member 1480, and a rear surface of the head 1481 may be formed of a surface having an inclined cross section.

The diverging passage 1484 extending in a longitudinal direction of the guide tube 1482 is formed in the guide tube 1482. An inlet passage 1485 communicating with the diverging passage 1484 is formed in a rear end of the guide tube 1482. A plurality of outlet passages 1486 communicating with a front end of the diverging passage 1484 are formed in a circumferential surface of the guide tube 1482. The inlet passage 1485 may have an inner diameter that is gradually reduced from its rear end to its front end.

The outer circumferential surface of the guide tube 1482 that has the outlet passages 1486 may have an inclined cross section such that an outer diameter of the guide tube 1482 is gradually reduced forward, that is, toward the front end of the guide tube 1482. That is, the outlet passages 1486 may occur in the guide tube 1482 along a lengthwise span only where the outer circumferential surface of the guide tube 1482 is inclined.

In this embodiment, three outlet passages 1486 may be formed in the guide tube 1482. Each outlet passage 1486 may be inclined outward from a central portion of the guide pipe 1482. Thus, the guide tube 1482 divides the flow of fuel into three flows. The divided fuel flows move along the guide groove 1483 formed in the head 1481 and swirl before being discharged through the injection hole 1432.

As described above, according to the first embodiment, the splash plate 1440 forms the first space 1413 and the injection slot 1416, which communicate with each other; and the first space 1413 is coupled with (communicates with) the air passage 1411 and the main fuel passage 1421 through the first connection hole 1457 and the second connection hole 1456. Therefore, not only can a fuel mixture flowing through the main fuel passage 1421 be more easily atomized, but the splash plate 1440 can also be efficiently cooled. Furthermore, the splash plate 1440 having a comparatively large area may be stably fixed to the outer tube 1410 by the struts 1415. In addition, the air curtain holes 1458 are formed in the curtain barrier 1453, whereby the front end of the nozzle 1400 can be efficiently cooled, and pilot fuel can be efficiently ejected from the nozzle 1400.

Hereinafter, a nozzle in accordance with a second embodiment of the present disclosure will be described.

Figure 7:
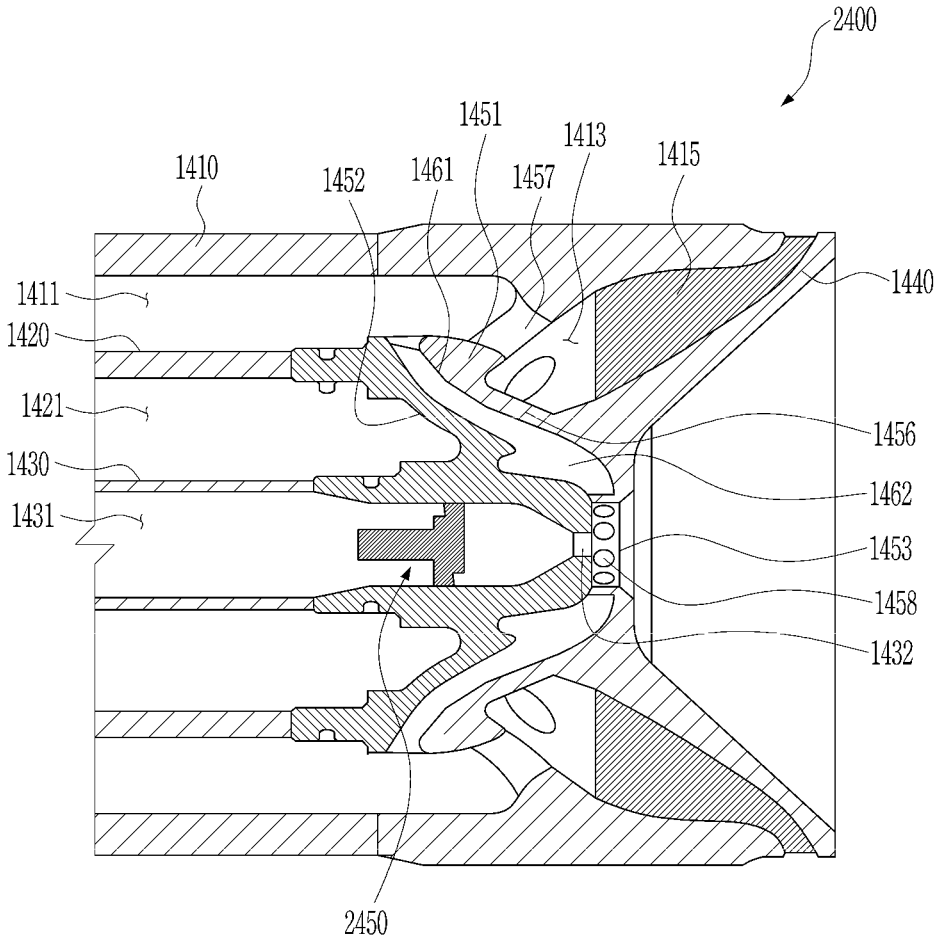
FIG. 7 is a sectional view of a nozzle in accordance with a second embodiment of the present disclosure.
Figure 8:
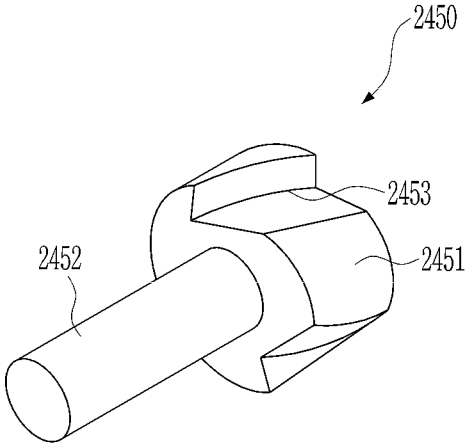
FIG. 8 is a perspective view of a flow guide member in accordance with the second embodiment of the present disclosure.

FIG. 7 illustrates a nozzle 2400 in accordance with the second embodiment of the present disclosure. FIG. 8 illustrates a flow guide member in the nozzle of FIG. 7. Here, other than the flow guide member 2450, the structure of the nozzle 2400 in accordance with the second embodiment is the same as that of the nozzle in accordance with the first embodiment. Therefore, duplicate description of the same structure will be omitted.

Referring to FIGS. 7 and 8, the flow guide member 2450 is inserted into the pilot fuel passage 1431. The flow guide member 2450 includes a head 2451 and a guide protrusion 2452 coupled with the head 2451. The head 2451 has a substantially cylindrical shape. A guide groove 2453 extending in a spiral shape is formed in an outer circumferential surface of the head 2451. In this embodiment, a plurality of guide grooves 2453 are formed in the head 2451, and each guide groove 2453 extends from a rear end of the head 2451 to its front end. The guide grooves 2453 spirally extend to enable the fuel to swirl. Each of front and rear surfaces of the head 2451 is formed of a planar surface that is perpendicular to the axis of the flow guide member 2450. The guide protrusion 2452 may protrude rearward from the rear surface of the head 2451 and be formed of a cylindrical structure having an outer diameter less than that of the head 2451.

Hereinafter, a nozzle in accordance with a third embodiment of the present disclosure will be described.

Figure 9:
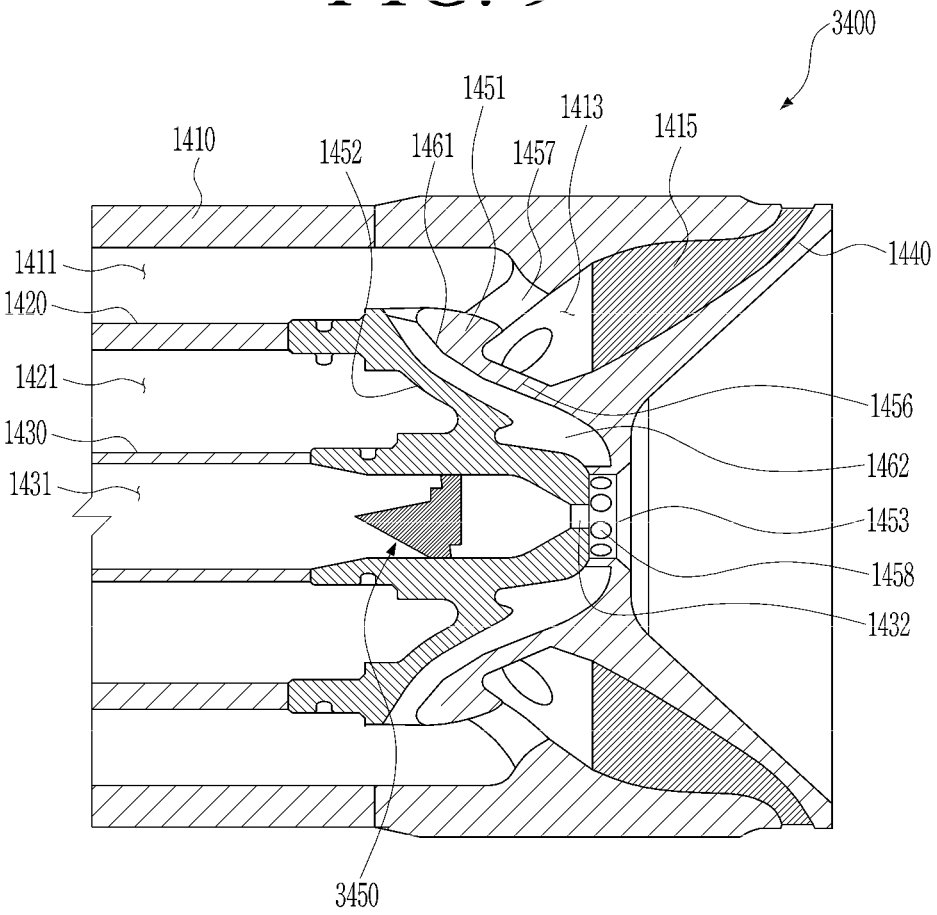
FIG. 9 is a sectional view of a nozzle in accordance with a third embodiment of the present disclosure.
Figure 10:
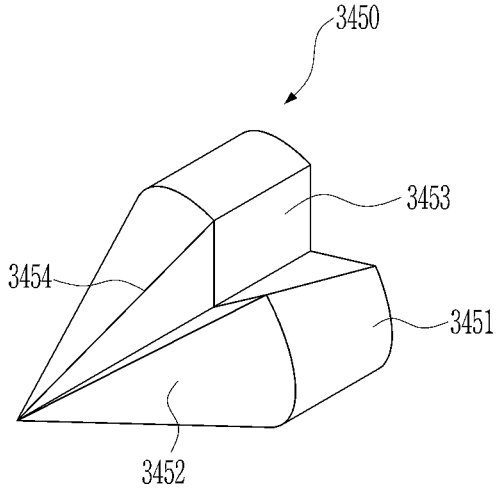
FIG. 10 is a perspective view of a flow guide member in accordance with the third embodiment of the present disclosure.

FIG. 9 illustrating a nozzle 3400 in accordance with the third embodiment of the present disclosure. FIG. 10 illustrates a flow guide member in the nozzle of FIG. 9. Here, other than the flow guide member 3450, the structure of the nozzle 3400 in accordance with the third embodiment is the same as that of the nozzle in accordance with the first embodiment. Therefore, duplicate description of the same structure will be omitted.

Referring to FIGS. 9 and 10, the flow guide member 3450 is inserted into the pilot fuel passage 1431. The flow guide member 3450 includes a head 3451 and a guide protrusion 3452 coupled with the head 3451. The head 3451 has a substantially cylindrical shape. A guide groove 3453 extending in a straight line is formed in an outer circumferential surface of the head 3451. In this embodiment, a plurality of guide grooves 3453 are formed in the head 3451, and each guide groove 3453 extends from a rear end of the head 3451 to its front end. A front surface of the head 3451 is formed of a planar surface. The guide protrusion 3452 protrudes rearward from the rear surface of the head 3451 and has a substantially conical shape. A plurality of channels 3454 extending outward from the center of the guide protrusion 3452 and extending in a longitudinal direction of the guide protrusion 3452 may be formed in an outer circumferential surface of the guide protrusion 3452. The channels 3454 may be aligned with so as to communicate with the respective guide grooves 3453. Thereby, fuel flowing along the pilot fuel passage 1431 may be more easily guided.

As described above, according to a nozzle, a combustor, and a gas turbine in accordance with an embodiment of the present disclosure, fuel may be efficiently atomized using a splash plate.

Furthermore, since an air curtain hole is employed, a cooling function may be efficiently performed while pilot fuel is atomized. In addition, since a strut is employed, the splash plate having a comparatively large area may be stably supported on an outer tube.

While the present disclosure has been described with respect to the specific embodiments, it will be apparent to those skilled in the art that various changes and modifications may be made without departing from the scope of the disclosure as defined in the following claims.

What is claimed is:

1. A nozzle for a combustor, comprising:

an outer tube;

a first inner tube installed in the outer tube and configured to form an air passage between the first inner tube and the outer tube;

a second inner tube installed in the first inner tube and configured to form a main fuel passage between the first inner tube and the second inner tube and to form a pilot fuel passage within the second inner tube, the pilot fuel passage having a front end in which an injection hole is formed;

a splash plate configured to form a first space between the outer tube and the splash plate, the first space communicating with the main fuel passage and with the air passage, and to form an injection slot communicating with the first space, the splash plate having a front end and a diameter increasing toward the front end;

a curtain barrier in which a plurality of air curtain holes for communicating with the air passage are formed, the curtain barrier disposed in front of the injection hole of the pilot fuel passage to enclose a space in front of the injection hole;

a first barrier between the first space and the air passage, in which a plurality of first connection holes are formed to connect the first space with the air passage; and a second barrier between the first space and the main fuel passage, in which a plurality of second connection holes are formed through a thickness of the second barrier to connect the first space with the main fuel passage and in which a plurality of connection passages extend through the second barrier to connect the air passage and the air curtain holes, wherein the first space includes a connected region and a divided region formed downstream of the connected region, the divided region communicating with the injection slot and the connected region communicating with the main fuel passage and with the air passage.

2. The nozzle according to claim 1, wherein the injection slot is formed between an outer circumferential surface of the outer tube and the front end of the splash plate.

3. The nozzle according to claim 1, further comprising a plurality of struts installed in the first space so as to couple the splash plate with the outer tube and arranged at positions spaced apart from each other in a circumferential direction of the first space.

4. The nozzle according to claim 3, wherein the divided region is divided into spaces by the struts, and wherein the connected region communicates with the spaces of the divided region and extends in a circumferential direction of the splash plate.

5. The nozzle according to claim 1, wherein each of the plurality of connections passages extends in a direction intersecting a direction of the plurality of second connection holes without communicating with any one of the plurality of the second connection holes.

6. The nozzle according to claim 5, further comprising:

a cooling guide flow passage extending in a circumferential direction of the second inner tube, wherein the plurality of connection passages communicate with the cooling passage.

7. The nozzle according to claim 5, wherein the nozzle has a front end formed by an inclined part formed by the splash plate; a planar part having a planar surface communicating with a rear end of the inclined part; and a recessed part formed in the planar part, the recessed part having a side surface formed by the curtain barrier and a bottom surface in which the injection hole is formed.

8. The nozzle according to claim 1, further comprising a flow guide member installed in the pilot fuel passage, the flow guide member including a head having an outer circumferential surface in which a guide groove extending in a spiral shape is formed.

9. The nozzle according to claim 8, wherein the flow guide member further includes a guide tube coupled with the head, and wherein the guide tube comprises:

a diverging passage communicating with an inlet passage formed in a rear end of the guide tube; and a plurality of outlet passages each communicating with a front end of the diverging passage and with an outer circumferential surface of the guide tube.

10. The nozzle according to claim 9, wherein the outer circumferential surface of the guide tube has an inclined cross section such that an outer diameter of the guide tube is gradually reduced toward a front end of the guide tube, and wherein the outlet passages occur in the guide tube where the outer circumferential surface of the guide tube is inclined.

11. The nozzle according to claim 8, wherein the flow guide member further includes a guide protrusion having a conical shape protrudes rearward from the head.

12. The nozzle according to claim 11, wherein the guide protrusion includes an outer circumferential surface in which a plurality of channels extending outward from a center of the guide protrusion and extending in a longitudinal direction of the guide protrusion are formed.

13. A combustor comprising a burner having a plurality of nozzles configured to eject fuel and air, and a duct assembly coupled to one side of the burner and configured to combust the ejected fuel and air and transfer combustion gas to a turbine, each nozzle comprising:

an outer tube;

a first inner tube installed in the outer tube and configured to form an air passage between the first inner tube and the outer tube;

a second inner tube installed in the first inner tube and configured to form a main fuel passage between the first inner tube and the second inner tube and to form a pilot fuel passage within the second inner tube;

a splash plate configured to form a first space between the outer tube and the splash plate, the first space communicating with the main fuel passage and with the air passage, form an injection slot communicating with the first space, and diffuse fuel transferred from the main fuel passage, wherein the first space includes a connected region and a divided region formed downstream of the connected region, the divided region communicating with the injection slot and the connected region communicating with the main fuel passage and with the air passage;

a curtain barrier in which a plurality of air curtain holes for communicating with the air passage are formed, the curtain barrier disposed in front of the injection hole of the pilot fuel passage to enclose a space in front of the injection hole;

a first barrier between the first space and the air passage, in which a plurality of first connection holes are formed to connect the first space with the air passage; and a second barrier between the first space and the main fuel passage, in which a plurality of second connection holes are formed through a thickness of the second barrier to connect the first space with the main fuel passage and in which a plurality of connection passages extend through the second barrier to connect the air passage and the air curtain holes.

14. The combustor according to claim 13, wherein the injection slot is formed between an outer circumferential surface of the outer tube and a front end of the splash plate.

15. The combustor according to claim 13, wherein each nozzle further comprises a plurality of struts installed in the first space so as to couple the splash plate with the outer tube and arranged at positions spaced apart from each other in a circumferential direction of the first space.

16. A gas turbine comprising a compressor configured to compress air drawn from an outside, a combustor configured to produce combustion gas by mixing fuel with the compressed air and combust the mixture, and a turbine including a plurality of turbine blades configured to be rotated by the combustion gas, wherein the combustor comprises a burner having a plurality of nozzles configured to eject fuel and air, and a duct assembly coupled to one side of the burner and configured to combust the ejected fuel and air and transfer the combustion gas to the turbine, each nozzle comprising:

an outer tube;

a first inner tube installed in the outer tube and configured to form an air passage between the first inner tube and the outer tube;

a second inner tube installed in the first inner tube and configured to form a main fuel passage between the first inner tube and the second inner tube and to form a pilot fuel passage within the second inner tube;

a splash plate configured to form a first space between the outer tube and the splash plate, the first space communicating with the main fuel passage and with the air passage, and to form an injection slot communicating with the first space;

a curtain barrier in which a plurality of air curtain holes for communicating with the air passage are formed;

a first barrier between the first space and the air passage, in which a plurality of first connection holes are formed to connect the first space with the air passage; and a second barrier between the first space and the main fuel passage, in which a plurality of second connection holes are formed through a thickness of the second barrier to connect the first space with the main fuel passage and in which a plurality of connection passages extend through the second barrier to connect the air passage and the air curtain holes, wherein the pilot fuel passage has a front end in which an injection hole is formed, and the curtain barrier is disposed in front of the injection hole to enclose a space in front of the injection hole, and wherein the first space includes a connected region and a divided region formed downstream of the connected region, the divided region communicating with the injection slot and the connected region communicating with the main fuel passage and with the air passage.

17. The gas turbine according to claim 16, wherein the splash plate having a front end and a diameter increasing toward the front end.

18. The gas turbine according to claim 17, wherein the injection slot is formed between an outer circumferential surface of the outer tube and the front end of the splash plate.

* * * * *